United States Patent [19]

Coffee et al.

[11] 4,421,281

[45] Dec. 20, 1983

[54] CONTAINERS AND HOLDERS THEREFOR FOR USE IN ELECTROSTATIC SPRAYING

[75] Inventors: Ronald A. Coffee, Haslemere; Peter C. Bennett, Churt, both of England

[73] Assignee: Imperial Chemical Industries PLC, London, England

[21] Appl. No.: 317,852

[22] Filed: Nov. 3, 1981

[30] Foreign Application Priority Data

Nov. 11, 1980 [GB] United Kingdom ..... 8036174

[51] Int. Cl.[3] ..... B05B 5/02

[52] U.S. Cl. ..... 239/690; 239/377; 222/481

[58] Field of Search ..... 239/690, 376, 377, 302, 239/379, 41, 42; 222/479, 481

[56] References Cited

U.S. PATENT DOCUMENTS

| | | | |
|---|---|---|---|
| 2,333,310 | 11/1943 | Greening | 222/481 |
| 4,209,134 | 6/1980 | Coffee | 239/690 |
| 4,275,846 | 6/1981 | Coffee . | |

*Primary Examiner*—John J. Love
*Assistant Examiner*—Gene A. Church
*Attorney, Agent, or Firm*—Cushman, Darby & Cushman

[57] ABSTRACT

A container for the electrostatic spraying of liquids, especially pesticides, having an integral conductive spray nozzle formed from two concentric tubes in which axial ribs and grooves between the tubes provide a liquid pathway to the nozzle mouth. Air is bled into the container in use through an extended pathway provided by a helical thread on the surface of a bung in the upper end of the inner tube.

6 Claims, 5 Drawing Figures

FIG.3.
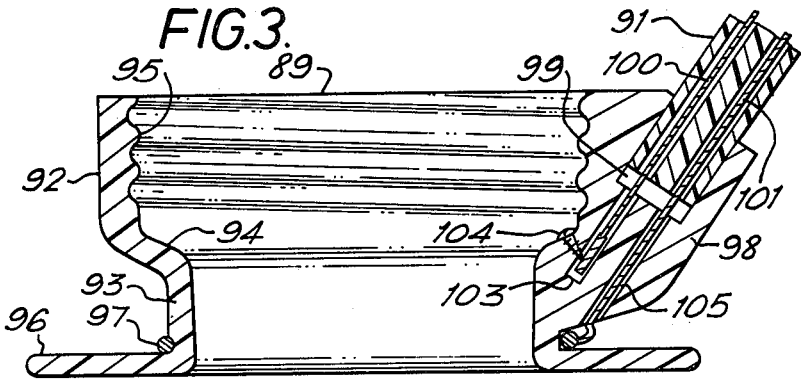
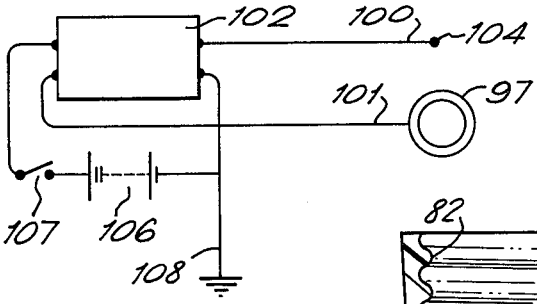
FIG.4.
FIG.5.
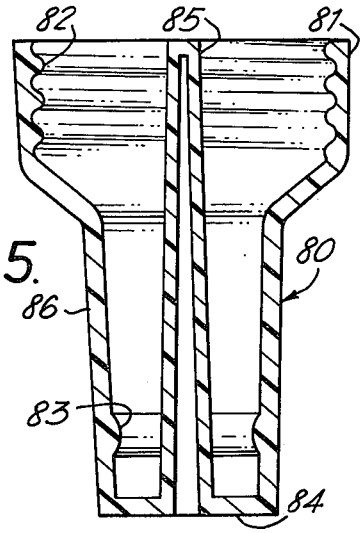

CONTAINERS AND HOLDERS THEREFOR FOR USE IN ELECTROSTATIC SPRAYING

This invention relates to containers therefor, and in particular to such containers for use in the electrostatic spraying of liquids.

In U.K. Pat. No. 1,569,707, we have described an apparatus for the electrostatic spraying of liquids. This apparatus is of simple construction, with a low power requirement (it has no moving parts and can readily be run off dry cells); it is thus particularly suited for use as a hand held sprayer in applications where large power sources are not readily available: for example, in spraying crops. Electrostatic spraying of crops also has advantages in promoting even coating of plants, with spray being attracted around behind foliage instead of coating only exposed surfaces; and in reducing spray drift, which is at best wasteful and at worst hazardous to the environment.

The apparatus disclosed in U.K. Pat. No. 1,569,707 comprises essentially a discharge nozzle; a field-intensifying electrode disposed around the nozzle; a container for supplying liquid to be sprayed to the nozzle; and a high voltage generator for applying a high voltage to the nozzle, the electrode being earthed. In this way a strong electric field may be produced between the nozzle and the electrode, sufficient to atomise liquid passing through the nozzle.

This apparatus is particularly suitable for the application of pesticides at low or ultra-low volume (typically at a spray application rate in the range 0.1 to 10 liters spray liquid per hectare). Low and ultra-low volume spraying have several recognised advantages, as well as being especially suitable where water is not readily available as a spray diluent, but they also have one disadvantage. Of necessity, they must use relatively concentrated pesticidal compositions. Such compositions frequently have a greater or lesser degree of human toxicity, and for this reason it is desirable that they should be handled as little as possible. A particular danger is the decantation of poisonous liquids into beverage bottles.

A pesticide sprayer, to provide the best service, must be reliable and adaptable. Desirably it should be able to spray pesticides of several different kinds. Different pesticides come in different formulations, having different electrical properties, and requiring to by sprayed in differing droplet sizes to give optimum effect. In the apparatus of U.K. Pat. No. 1,569,707 useful and convenient control over droplet size and spraying properties can be provided by varying the applied voltage; but the size of the nozzle and its position relative to the surrounding electrode may also require adjustment to suit the formulation being sprayed. It is often difficult to do this reliably in the field. Also, pesticide sprayers (spray-tanks, spray-lines and nozzles) normally require careful cleaning between application of different pesticides; otherwise, for example, traces of herbicide may damage crops being sprayed against fungal attack. The need for such cleaning is increased when formulations are to be sprayed electrostatically, since contamination may affect their electrical properties. Thorough cleaning may damage nozzles, leading to incorrect spray application.

Containers suitable for use in electrostatic spraying apparatus of the kind described in U.K. Pat. No. 1,569,707 that enable a number of the problems outlined above to be mitigated or overcome are disclosed in published U.K. patent applications 2030060 and 2061769.

In the above U.K. patent applications, we disclose inter alia a container for a liquid to be electrostatically sprayed, suitable for mounting on a holder to form apparatus including carrying a high voltage generator, a power source, a field-intensifying electrode and electrical connections for connecting the field-intensifying electrode to one output terminal of the high voltage generator, the container having an electrically conductive spray nozzle and mounting means for locating the container on the holder, the mounting means being provided with electrical contacts to connect the nozzle to the high voltage generator.

To give the best results in practice, such containers require to deliver liquid at a constant flow rate over as much as possible of their delivery cycle. It is also desirable that the delivery of liquid from such containers should be affected as little as possible by small movements of the container ('bounce sensitivity') or by small variations in the angle at which the container is held ('tilt sensitivity'). It is accordingly an object of the present invention to provide an improved container having a more nearly constant liquid delivery rate that is also less sensitive to temperature variation, as well as improved tilt sensitivity and bounce sensitivity.

Accordingly, the invention comprises a container for mounting on a holder for the electrostatic spraying of liquids said container including a vessel having a neck, and an electrically-conductive nozzle in said neck having a body, a mouth for dispensing liquid from the vessel and an air-bleed for feeding air into the vessel:

said body comprising vertically aligned co-axial outer and inner tubes, the outer tube being shorter and having a height at least twice its diameter and said inner tube having an upper end extending at least into the neck of the vessel;

said mouth being formed by the radial gap between adjacent lower ends of the tubes;

ribs being provided on the surface of one tube to space it from the second tube and to form channels communicating with the vessel to deliver liquid therefrom to the mouth;

said air-bleed comprising a bung supported within the bore of the upper end of said inner tube, the bung and the bore co-operating to provide an extended pathway through which air can enter the vessel.

A holder suitable for receiving a container according to the invention may comprise a body carrying a high voltage generator, a power source therefor, a field-intensifying electrode, electrical connections for connecting the electrode to earth and mounting means complementary to mounting means on the container for locating the container on the holder with the spray orifice adjacent the electrode and the nozzle connected to an output terminal of the high voltage generator. Throughout this specification, the term 'conducting surface' is intended to include a semi-conducting surface.

Prior to mounting on the holder, the container nozzle requires to be sealed against the emission of liquid. Conventional sealing means may be employed, for example a screw cap seal over the nozzle.

Preferably means are provided on the holder for maintaining one output terminal of the high voltage generator at or near earth potential. Such means may be a conductor for connection to earth, for example, a trailing earth wire dependant from the holder. Where such means are provided, it is preferred that the earthed terminal of the high voltage generator is arranged for connection to the field-intensifying electrode rather than to the container nozzle. Charging of the spray is then by direct contact, rather than by induction, and there is a stronger electrostatic field transporting the spray to its (earthed) target.

The field-intensifying electrode may be of bare metal or may be wholly or partially covered with insulating material.

Containers according to the invention may be filled with properly formulated spray liquid by the manufacturer, and after the containers are closed, the spray liquid will remain uncontaminated until it is actually sprayed. There is no need to clean spray-tanks, spray-lines or nozzles to avoid contamination, so different products can be sprayed successively without undue loss of time. Toxic hazards through handling by operators are minimised; errors by field operators in mixing and dilution procedures are eliminated. After use, the containers according to the invention may be returned to the manufacturer for refilling; or may be discarded. Containers may be made from one or more elements of plastics material by, for example, injection moulding or blow moulding, or a combination of the two. The conducting elements of the containers (nozzle, contact and connections) may be provided by metal inserts, or by application of conductive metallic coatings or paints to the container surface or by the use of partly-conducting plastics.

One suitable form of power source is an electrical storage battery. The amount of electrical energy required to atomise liquid is remarkably low. A typical example may be considered: a vessel containing 500 ml of liquid to be sprayed at a rate of 0.5 ml per second, with a droplet size of about 100 microns, and a charge to mass ratio of $5\times10^{-3}$ coulombs per kilgram. The current carried by droplets atomising from the nozzle is thus 2.5 microamperes. The spraying time will be 1000 seconds (just over quarter of an hour) at an input current of, typically, 15 milliamperes, an input voltage of about 10 volts and an output voltage of 20 kilovolts. Thus the required cell rating to spray liquid from one such vessel is only 4 milliampere hours, at about 10 volts. This capacity is considerably less than that of most readily available torch batteries. An example of another form of power source which may be used in the invention is a solar cell. In certain embodiments of the invention, the power source may be carried on the container, rather than the holder. Suitable high voltages for use in the invention range from about 1 to about 30 kilovolts, and most conveniently from about 15 to about 25 kilovolts.

A specific embodiment of the invention will now be described with reference to the drawings, in which:

FIG. 3 is a vertical section through a holder for the container.

FIG. 4 is a circuit design for the holder of FIG. 3.

FIG. 5 is a vertical section through a cap for the nozzle of FIG. 1.

Figure 1:
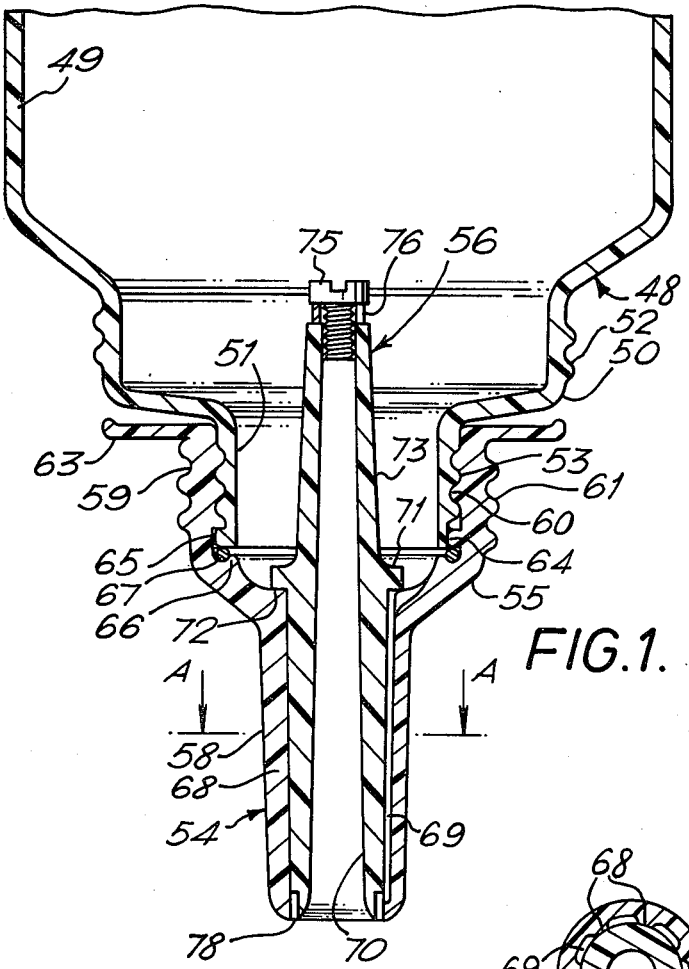
FIG. 1 is a vertical section through the nozzle and neck of the container.
Figure 2:
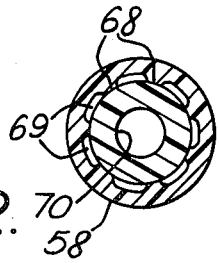
FIG. 2 is a horizontal section on the line A—A in FIG. 1.

The container (48), shown in FIGS. 1 and 2, comprises a bottle (49), formed by processes including blow-moulding from clear polyethylene terephthalate, having a shoulder (50) with an exterior thread (52) and a neck (51) with an exterior thread (53). The neck (51) carries an annular nozzle (54) threaded thereon. This nozzle is injection-moulded from conductive plastics material (nylon containing 20% by weight carbon black) in two pieces (55) and (56) forming respectively the outer and inner wall elements of the nozzle (54). Outer wall (55) comprises a tube (58) having at its upper end an enlarged skirt (59) carrying inner and outer threads (60) and (61). From the upper end of skirt (59), a resiliently deformable flange (63) extends outwardly.

Below inner thread (60) a set of ratchet teeth (64) are formed round the inner circumference of skirt (59). Thread (60) on skirt (59) mates with thread (53) on bottle (59); when the two are screwed together ratchet teeth (64) engage with a mating set of ratchet teeth (65) fixed in the outer lip of neck (51) of the bottle (49). This prevents bottle (49) and nozzle (54), once assembled, from being taken apart again. At the base of skirt (59) a circumferential wier (66) supports a resilient rubber O-ring (67); this acts as a liquid-tight seal between nozzle (54) and the lip of neck (51).

Tube (58) is formed with seven vertical ribs (68), separated by channels (69). Within tube (58) is carried inner wall element (56) of the annular nozzle (54). This is also generally tubular in shape and comprises a bottom portion (70) which is a push-fit into tube (58), fitting snugly within it against ribs (68); a central radial flange (71) which abuts the heads (72) of the ribs (68), and an upper portion (73) with a mouth partially closed by a threaded screw (75) which is a push-fit therein. The mouth has three castellations (76) which expose part of the thread of the screw (75); the inner bore of mouth is smooth, not threaded. The screw 75 comprises a bung, the helical threads of the screw 75 and the smooth bore of element 56 providing an extended air-bleed pathway. The lower end of bottom portion (70) is formed with a circumferential indentation forming an annular orifice (78) between inner and outer walls (55) and (56). The channels (69) lead into this orifice (78).

FIG. 5 shows a cap (80) formed of high-impact nylon which may be screwed on to nozzle (54) to retain liquid during carriage and storage. It comprises a skirt (81) externally milled with internal thread (82) for mating with the external thread (61) on the nozzle (54). Skirt (81) has a dependent wall (86) fixed with an inner circumferential projection (83) which in use forms a liquid-tight seal against the outer wall of tube (58). From the base (84) of cap (80) a long nose (85) projects upwardly; in use this has no sealing function, but fills most of the space between screw (75) and projection (83) so that the minimum of liquid is lost when cap (80) is removed.

FIGS. 3 and 4 show a holder (90) for container (48) consisting of a plastics support (89) and a carrying handle (91). The support (89) is of tough rigid non-conducting plastics material (e.g. glass-filled nylon or, better, talc-filled polypropylene) and comprises two short coaxial hollow cylinders (92) and (93) connected by a sloping shoulder (94). The upper cylinder (92) has an internal thread (95) which will receive and mate with the external thread (52) of bottle (49). Lower cylinder (93) is wide enough to admit nozzle (54) carrying cap (80), with a small clearance. The bottom of cylinder (93) is formed with an outwardly-directed radial flange (96). Just above flange (96), at the base of cylinder (93), is a bare metal annulus (97). At one side of support (89) is a large lug (98), formed with a socket (99) for receiving the end of carrying handle (91), a rod of insulating plastics material (such as fiberglass). Within handle (91)

are carried two electrical leads (100) and (101), the former being connected to one output terminal of 25 KV high voltage generator (102) carried in the handle (91), and the latter being connected to earth. Lead (100) is accommodated in blind bore (103) adjacent the interior surface of shoulder (94), and makes contact with round-headed self-tapping metal screw (104). Lead (101) passes through bore (105) and is connected to metal annulus (97). As shown in the circuit diagram of FIG. 10, generator (102) is powered by four 1.5 volt flashlight batteries (106) through a spring-loaded push button switch (107). Generator (102), batteries (106) and switch (107) are all mounted on handle (91). The earth connection (108) is provided through a trailing bare wire carried in a plastic twine base.

In use, bottle (49) is first filled with a suitable liquid for spraying (e.g. a 10% by weight formulation of a fungicide in a hydrocarbon solvent, the formulation having a resistivity of $1\times10^8$ ohm cm and a viscosity of 5 centistokes, both measured at 20° C.). Nozzle (54) is then screwed on to thread (53), and ratchet teeth (64) and (65) engage, fixing nozzle (54) permanently in position. Cap (80) is then screwed on to thread (61). The container (48) so formed is now transported to the site at which it is desired to use it. Here it is screwed into holder (89), using threads (52) and (95). Flange (63) contacts the head of screw (104). Handle (92) is now used to hold container (48) nozzle downwards over the target it is desired to spray, and cap (80) is removed. Liquid begins to drip out of annulus (78), while air is sucked into the container up the central bore of insert (56). To enter the container, air has to pass along the long helical groove formed between the thread of nut (75) and the smooth inner surface of the mouth of tube (56). The generator (102) is activated by depressing the switch (107), thereby communicating a potential of 25 KV to the nozzle (54) via lead (100), screw (104) and flange (63). A powerful electric field is generated between the charged nozzle orifice (78) and the earthed conductor (97). This draws out the liquid leaving the orifice (78) into ligaments, which break up into highly charged particles of uniform size, which are attracted to and evenly coat the target.

The form of nozzle shown in FIGS. 1–5 produces a steady flow-rate after a short period (of the order of 45 seconds) in which equilibrium is reached. The equilibrium flow-rate for a liquid of given viscosity is dependent on the width, breadth and number of the channels (69) and the length and cross-section of the air-bleed channel. In the embodiment shown, the seven channels (69) are 0.3 mm deep and 1.6 mm wide, the annular orifice being 0.3 mm in width with an external diameter of 13 mm; the path of the helical air-bleed is about 9–10 cm long, with a cross-section of about 0.4 sq. mm. and the resulting flow-rate is about 0.07 ml/second. For greater or lesser flow-rates, it is simplest to change the number of channels (69) rather than their depth or thickness, e.g. to 4 or 16 channels to approximately halve or double the flow-rate, respectively. As well as giving a steady flow-rate, this nozzle is not sensitive to tilting and continues to operate satisfactorily when held at an angle of, e.g., 30% to the vertical.

Various modifications to the foregoing apparatus will be apparent to those skilled in the art. The container illustrated is intended to be disposable. However, reusable containers may also be made. Instead of the helical air-bleed channel, a longer plug with, e.g. a vertical groove, may be used to provide an air-bleed.

The device described includes a conductor for connection to earth in the form of a trailing bare metal wire. This has the disadvantage that it may become caught up or tangled. The device works best with an earth connection; but it need not be of low resistance. The conductor for connection to earth may be, for example a metallised strip along the handle of the holder. When the operator grasps the handle, an electrical pathway to earth is formed through the operator's body. Though this pathway has high resistance, we have found that it is generally adequate. Experiments have shown that, with an arrangement of this kind, the voltage on the container electrode may be up to about one or two hundred volts above that of earth, even when the operator is wearing rubber boots in relatively dry conditions. Such a voltage on the electrode is little different from that of earth, relative to the potential on the nozzle of several thousand volts. The current flowing through the operator is so small that there is no danger to him whatever, nor can he even feel anything.

The apparatus of the invention has been described with particular reference to its use in pesticide spraying, in particular of compositions comprising pesticides in organic liquid carriers, for which it has special advantages. However, it may also be used for spraying of coatings or paints, for example by the home decorator. Holders for the container are conveniently adapted for holding in the hand; but they may also be carried on vehicles such as tractors or aircraft, when they may support more than one container. In this case, the power source may be a battery or generator carried in the vehicle.

We claim:

1. A container for mounting on a holder for the electrostatic spraying of liquids said container including a vessel having a neck and an electrically-conductive nozzle in said neck having a body, a mouth for dispensing liquid from the vessel and a permanent predetermined air-bleed for feeding air into the vessel:

said body comprising vertically aligned co-axial outer and inner tubes, the outer tube being shorter and having a height at least twice its diameter and said inner tube having an upper end extending at least into the neck of the vessel;

said mouth being formed by the radial gap between adjacent lower ends of the tubes;

ribs being provided on the surface of one tube to space it from the second tube and to form channels communicating with the vessel to deliver liquid therefrom to the mouth; and said air-bleed comprising a bung supported within the bore of the upper end of said inner tube, the bung and the bore co-operating to provide a predetermined non-adjustable extended pathway through which air can enter the vessel.

2. A container as claimed in claim 1, wherein the neck of the container is externally threaded to mate with a threaded annulus on the holder.

3. A container as claimed in claim 1, wherein the outer tube is formed with a projecting resilient radial flange at its upper end, to provide an electrical connection to a high voltage contact stud on the holder.

4. A container as claimed in claim 1, provided with a sealing cap having a central member upwardly extending from the cap base to at least partially fill the interior of the inner tube.

5. A container as recited in claim 1 wherein said bung comprises a shaft having an external helical thread, and wherein said upper end of said inner tube has a smooth wall, said exterior helical thread of said bung abutting said smooth wall; said air-bleed extended pathway being formed by the volume between said helical thread and said smooth wall.

6. A container for mounting on a holder for the electrostatic spraying of liquids, the container including a vessel having a neck and an electrically-conductive nozzle in the neck having a body, and a mouth for dispensing liquid from the vessel;

said body comprising vertically aligned co-axial outer and inner tubes, the outer tube being shorter and said inner tube having an upper end extending at least into the neck of the vessel, said inner tube upper end being smooth-walled;

said mouth being formed by the radial gap between adjacent lower ends of the tubes;

ribs provided on the surface of one tube to space it from the second tube and to form channels communicating with the vessel to deliver liquid therefrom to the mouth; and a bung having an exterior helical thread, said bung mounted in said inner tube upper end so that said helical thread substantially engages said smooth wall, a helical groove being defined by said helical external thread and said smooth wall, and said helical groove comprising an air-bleed extended pathway for feeding air into the vessel.

* * * * *